US009093027B2

(12) United States Patent
Jin et al.

(10) Patent No.: US 9,093,027 B2
(45) Date of Patent: Jul. 28, 2015

(54) DISPLAY DEVICE AND DRIVING METHOD THEREOF

(71) Applicants: Guang hai Jin, Yongin (KR); Dong-Gyu Kim, Yongin (KR); Kwan-Wook Jung, Yongin (KR); Ho-Young Kim, Yongin (KR); June-Woo Lee, Yongin (KR); In-Ho Choi, Yongin (KR)

(72) Inventors: Guang hai Jin, Yongin (KR); Dong-Gyu Kim, Yongin (KR); Kwan-Wook Jung, Yongin (KR); Ho-Young Kim, Yongin (KR); June-Woo Lee, Yongin (KR); In-Ho Choi, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 259 days.

(21) Appl. No.: 13/751,263

(22) Filed: Jan. 28, 2013

(65) Prior Publication Data

US 2014/0071027 A1 Mar. 13, 2014

(30) Foreign Application Priority Data

Sep. 10, 2012 (KR) ..... 10-2012-0100104

(51) Int. Cl.
*G09G 3/32* (2006.01)

(52) U.S. Cl.
CPC ..... *G09G 3/3233* (2013.01); *G09G 3/3291* (2013.01); *G09G 2300/0852* (2013.01); *G09G 2300/0861* (2013.01)

(58) Field of Classification Search
CPC ..... G09G 3/3208; G09G 2310/0262; G09G 2330/02
USPC ..... 345/76
See application file for complete search history.

(56) References Cited

U.S. PATENT DOCUMENTS

| | | | | |
|---|---|---|---|---|
| 7,880,380 | B2 * | 2/2011 | Yamazaki et al. | 313/506 |
| 7,999,800 | B2 * | 8/2011 | Iwabuchi et al. | 345/204 |
| 2004/0246241 | A1 * | 12/2004 | Sato et al. | 345/204 |
| 2004/0256617 | A1 * | 12/2004 | Yamada et al. | 257/59 |
| 2005/0157581 | A1 * | 7/2005 | Shiurasaki et al. | 365/230.06 |
| 2006/0028408 | A1 * | 2/2006 | Kim | 345/76 |
| 2006/0138600 | A1 * | 6/2006 | Miyazawa | 257/630 |
| 2009/0284519 | A1 * | 11/2009 | Kim et al. | 345/213 |
| 2011/0025671 | A1 * | 2/2011 | Lee | 345/211 |
| 2012/0146979 | A1 * | 6/2012 | Kim et al. | 345/211 |

FOREIGN PATENT DOCUMENTS

| | | | |
|---|---|---|---|
| KR | 10-2008-0100016 | A | 11/2008 |
| KR | 10-2009-0104639 | A | 10/2009 |
| KR | 10-2011-0013693 | A | 2/2011 |

* cited by examiner

*Primary Examiner* — Dorothy Harris
(74) *Attorney, Agent, or Firm* — Lee & Morse, P.C.

(57) ABSTRACT

A display device includes a plurality of pixels, each pixel including an organic light emitting diode (OLED) and a driving transistor, a sustain power supply unit applying a first sustain voltage to a plurality of data lines connected to the plurality of pixels, and a data driver applying one of a data signal and a second sustain voltage to the plurality of data lines. For each pixel, the sustain power supply unit applies the first sustain voltage as a first level voltage to reset a gate voltage of the driving transistor and applies the first sustain voltage as a second level voltage to increase the gate voltage of the driving transistor. When an anode voltage of the OLED in each pixel is discharged to be reset, the anode voltage of the OLED is controlled according to a voltage difference between the first level voltage and the second level voltage.

16 Claims, 5 Drawing Sheets

DISPLAY DEVICE AND DRIVING METHOD THEREOF

CROSS-REFERENCE TO RELATED APPLICATION

This application claims priority under 35 U.S.C. §119 to and the benefit of Korean Patent Application No. 10-2012-0100104 filed in the Korean Intellectual Property Office on Sep. 10, 2012, the entire contents of which are incorporated herein by reference.

BACKGROUND OF THE INVENTION

1. Field of the Invention

Embodiments relate to an active matrix organic light emitting diode (OLED) display and a driving method thereof.

2. Description of the Related Art

An organic light emitting diode (OLED) display uses an organic light emitting diode (OLED) having luminance that is controlled by a current or a voltage. The organic light emitting diode (OLED) includes an anode and a cathode forming an electric field, and an organic light emitting material emitting light by the electric field.

In general, organic light emitting diode (OLED) displays are classified into a passive matrix type of OLED (PMOLED) and an active matrix type of OLED (AMOLED) according to a driving method of the organic light emitting diode (OLED). The active matrix type, in which unit pixels are selectively lit, is primarily used because of good of resolution, contrast, and operation speed.

One pixel of the active matrix OLED includes the organic light emitting diode (OLED), a driving transistor controlling a current amount supplied to the organic light emitting diode (OLED), and a switching transistor transmitting a data signal controlling a light emitting amount of the organic light emitting diode (OLED) to the driving transistor.

In one frame, the driving transistor supplies a current corresponding to the data voltage applied to the gate electrode to the organic light emitting diode (OLED). In a next frame, the gate voltage of the driving transistor must be reset to remove hysteresis. If the gate voltage of the driving transistor of the previous frame is not sufficiently reset, the data voltage is incorrectly reflected to the gate electrode of the driving transistor such that the organic light emitting diode (OLED) may not emit the light with desired brightness, and thereby image quality of the display device may be deteriorated.

The above information disclosed in this Background section is only for enhancement of understanding of the background of and therefore it may contain information that does not form the prior art that is already known in this country to a person of ordinary skill in the art.

SUMMARY OF THE INVENTION

One or more embodiments are directed to a display device that includes a plurality of pixels, a sustain power supply unit applying a first sustain voltage to a plurality of data lines connected to a plurality of pixels; and a data driver applying one of a data signal and a second sustain voltage to a plurality of data lines, wherein the sustain power supply unit applies the first sustain voltage as a first level voltage to reset the gate voltage of the driving transistor included in a plurality of pixels, and applies the first sustain voltage as a second level voltage to increase the gate voltage of the driving transistor, and when the anode voltage of the organic light emitting diode (OLED) included in a plurality of pixels is discharged to be reset, the anode voltage of the organic light emitting diode (OLED) is controlled according to the voltage difference between the first level voltage and the second level voltage.

A plurality of pixels may respectively include: an organic light emitting diode (OLED); a driving transistor controlling a driving current supplied to the organic light emitting diode (OLED); a compensation capacitor including one electrode connected to the gate electrode of the driving transistor; a switching transistor connecting the other electrode of the compensation capacitor and the data line; and a compensation transistor connecting the gate electrode of the driving transistor and the anode of the organic light emitting diode (OLED).

A MUX unit connecting one of the sustain power supply unit and the data driver to a plurality of data lines may be further included.

The MUX unit may include a plurality of unit MUXs respectively connected to a plurality of data lines, and the unit MUX may include: a first transistor including a gate electrode applied with the driving control signal, one electrode connected to the sustain power supply unit, and the other electrode connected to the data line; and a second transistor including a gate electrode applied with the driving control signal, one electrode connected to the data driver, and the other electrode connected to the data line, wherein one of the first transistor and the second transistor may be a p-channel field effect transistor, and the other may be an n-channel field effect transistor.

A power supply unit determining a level of a first power source voltage and a second power source voltage providing a driving current of the organic light emitting diode (OLED) and supplying the level to the power source line connected to a plurality of pixels may be further included.

After the gate voltage of the driving transistor is increased, the power supply unit may reverse the voltage difference between the first power source voltage and the second power source voltage to reset the anode voltage of the organic light emitting diode (OLED).

A compensation control signal unit applying a compensation control signal to the gate electrode of the compensation transistor to diode-connect the driving transistor and storing a voltage of which the threshold voltage of the driving transistor is reflected to the compensation capacitor may be further included.

When the driving transistor is diode-connected, the MUX unit may connect the data driver to a plurality of data lines, and the data driver may apply the second sustain voltage to a plurality of data lines.

A scan driver sequentially applying a plurality of scan signals to a plurality of scan line connected to a plurality of pixels may be further included, and the data driver may apply the data signal to a plurality of data lines by corresponding to a plurality of scan signals to write the data to a plurality of pixels.

After writing the data to a plurality of pixels, the power supply unit may change one voltage level of the first power source voltage and the second power source voltage to simultaneously emit a plurality of pixels.

One or more embodiments may provide a method of driving a display device including a plurality of pixels including an organic light emitting diode (OLED), a driving transistor controlling a driving current supplied to the organic light emitting diode (OLED), and a compensation capacitor having one electrode connected to a gate electrode of the driving transistor, the method including: applying a first sustain voltage to the other electrode of the compensation capacitor as a first level voltage to reset a gate voltage of the driving transistor; applying the first sustain voltage to the other electrode of the compensation capacitor as a second level voltage to increase the gate voltage of the driving transistor; discharging an anode voltage of the organic light emitting diode (OLED) to be reset; storing a voltage reflected by a threshold voltage of the driving transistor to the compensation capacitor; applying a data voltage to the other electrode of the compensation capacitor to reflect the data voltage to the gate voltage of the driving transistor; and light emitting the organic light emitting diode (OLED) according to the current flowing in the driving transistor by the gate voltage reflected by the data voltage, wherein in the discharging and the resetting of the anode voltage of the organic light emitting diode (OLED), the anode voltage of the organic light emitting diode (OLED) is controlled according to the voltage difference between the first level voltage and the second level voltage.

The storing of the voltage in which the threshold voltage of the driving transistor is reflected to the compensation capacitor may include applying a second sustain voltage to the other electrode of the compensation capacitor; and diode-connecting the driving transistor.

The reflecting of the data voltage to the gate voltage of the driving transistor may include applying the first power source voltage and the second power source voltage providing the driving current of the organic light emitting diode (OLED) with the same voltage level.

The light emitting of the organic light emitting diode (OLED) may include generating a voltage difference between the first power source voltage and the second power source voltage by changing one voltage level of the first power source voltage and the second power source voltage.

The light emitting of the organic light emitting diode (OLED) may be simultaneously performed in a plurality of pixels.

The reverse bias generated in the organic light emitting diode (OLED) and the dark spot generated in the screen may be minimized, thereby improving the display quality of the display device.

DETAILED DESCRIPTION OF THE EMBODIMENTS

Figure 1:
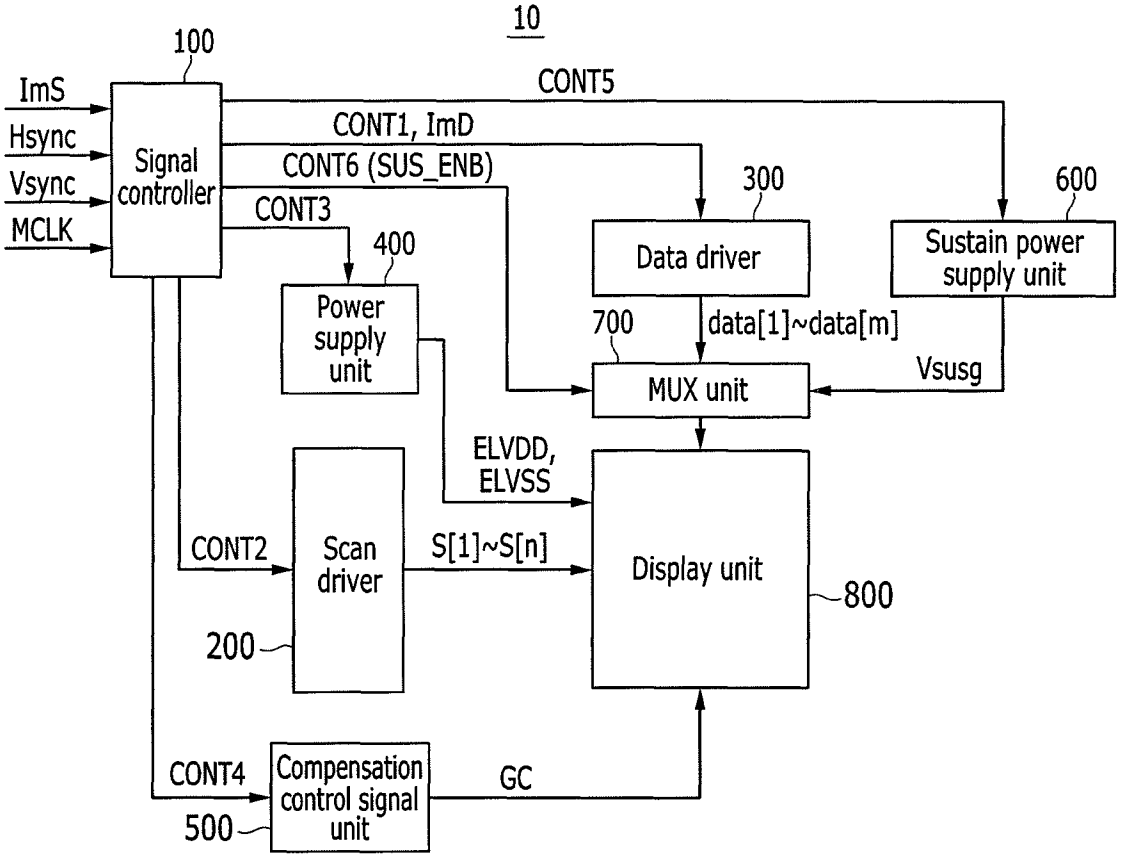
FIG. 1 is a block diagram of a display device according to an exemplary embodiment.

In the following detailed description, only certain exemplary embodiments of have been shown and described, simply by way of illustration.

The drawings and description are to be regarded as illustrative in nature and not restrictive, and like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment. Referring to FIG. 1, a display device 10 includes a signal controller 100, a scan driver 200, a data driver 300, a power supply unit 400, a compensation control signal unit 500, a sustain power supply unit 600, a MUX unit 700, and a display unit 800.

The signal controller 100 receives a video signal Ims and a synchronization signal input from an external device. The input video signal ImS includes luminance information on a plurality of pixels. The luminance has a predetermined number of grays, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates the first to the sixth driving control signals CONT1, CONT2, CONT3, CONT4, CONT5, and CONTE, and an image data signal ImD according to the video signal ImS, the horizontal synchronization signal Hsync, the vertical synchronization signal Vsync, and the main clock signal MCLK.

The signal controller 100 generates the image data signal ImD by dividing the video signal ImS into a frame unit according to the vertical synchronization signal Vsync and dividing the image data signal ImS into a scan line unit according to the horizontal synchronization signal Hsync. The signal controller 100 transmits the image data signal ImD along with the first driving control signal CONT1 to the data driver 300.

The display unit 800 is a display area including a plurality of pixels. A plurality of scan lines substantially extend in a row direction and almost parallel with each other, and a plurality of data lines and a plurality of power lines substantially extend in a column direction and almost parallel with each other are formed in the display unit 800. The scan lines, the data lines, and the power lines are connected to the plurality of pixels. The plurality of pixels may be arranged substantially in a matrix format.

The scan driver 200 is connected to a plurality of scan lines and generates a plurality of scan signals S[1]-S[n] according to the second driving control signal CONT2. The scan driver 200 may sequentially apply the scan signals S[1]-S[n] of the gate-on voltage to a plurality of scan lines.

The data driver 300 is connected to a plurality of data lines through the MUX unit 700. The data driver 300 samples and holds the image data signal ImD input according to the first driving control signal CONT1 and transmits a plurality of data signals data[1]-data[m] to a plurality of data lines. The data driver 300 applies the data signals data[1]-data[m] having a predetermined voltage range to a plurality of data lines by corresponding to the scan signals S[1]-S[n] of the gate-on voltage.

The power supply unit 400 determines a level of the first power source voltage ELVDD and the second power source voltage ELVSS according to the third driving control signal CONT3 to supply the level to the power source line connected to a plurality of pixels. The first power source voltage ELVDD and the second power source voltage ELVSS provide the driving current of the pixel.

The compensation control signal unit 500 determines the level of the compensation control signal GC according to the fourth driving control signal CONT4 to apply it to a compensation control line connected to a plurality of pixels.

The sustain power supply unit 600 is connected to a plurality of data lines through the MUX unit 700 and determines the level of the first sustain voltage Vsusg according to the fifth driving control signal CONT5 to apply it to a plurality of data lines. The sustain power supply unit 600 applies the first sustain voltage Vsusg as the first level to reset the gate voltage of the driving transistor included in a plurality of pixels, and applies the first sustain voltage Vsusg as the second level to control a voltage difference between both terminals of the organic light emitting diode (OLED) included in a plurality of pixels.

The MUX unit 700 connects one of the data driver 300 and the sustain power supply unit 600 to a plurality of data lines according to the sixth driving control signal CONT6. That is, the MUX unit 700 applies one of the data signals data[1]-data [m] and the first sustain voltage Vsusg to a plurality of data lines. The sixth driving control signal CONT6 may be referred to as a sustain voltage enable signal SUS_ENB applying the first sustain voltage Vsusg to a plurality of data lines.

Figure 2:
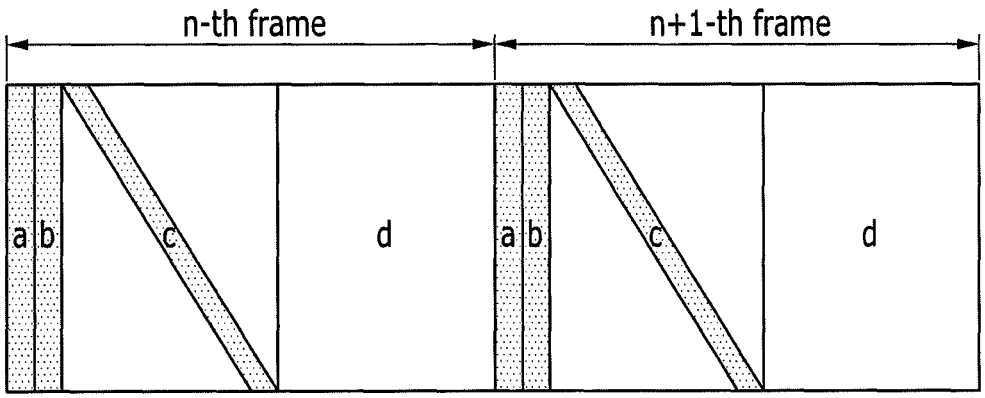
FIG. 2 is a diagram showing an operation of a simultaneous light emitting method of a display device according to an exemplary embodiment.

FIG. 2 is a diagram showing an operation of a simultaneous light emitting method of a display device according to an exemplary embodiment. Referring to FIG. 2, the display device 10 according to the exemplary embodiment is described as an organic light emitting diode display using an organic light emitting diode. However, embodiments are not limited thereto, and may be applied to various display devices.

One frame period in which one image is displayed to the display unit 800 includes a reset period (a) resetting the driving voltage of the organic light emitting diode (OLED) of the pixel, a compensation period (b) compensating a threshold voltage of the driving transistor of the pixel, a scan period (c) in which the data signal is transmitted to a plurality of pixels, and a light emitting period (d) in which a plurality of pixels emit the light corresponding to the transmitted data signal.

As shown, the operation in the scan period (c) is sequentially performed for each scan line, however the display operation of the reset period (a), the compensation period (b), and the light emitting period (d) are simultaneously and totally performed in the entire display unit 600.

Figure 3:
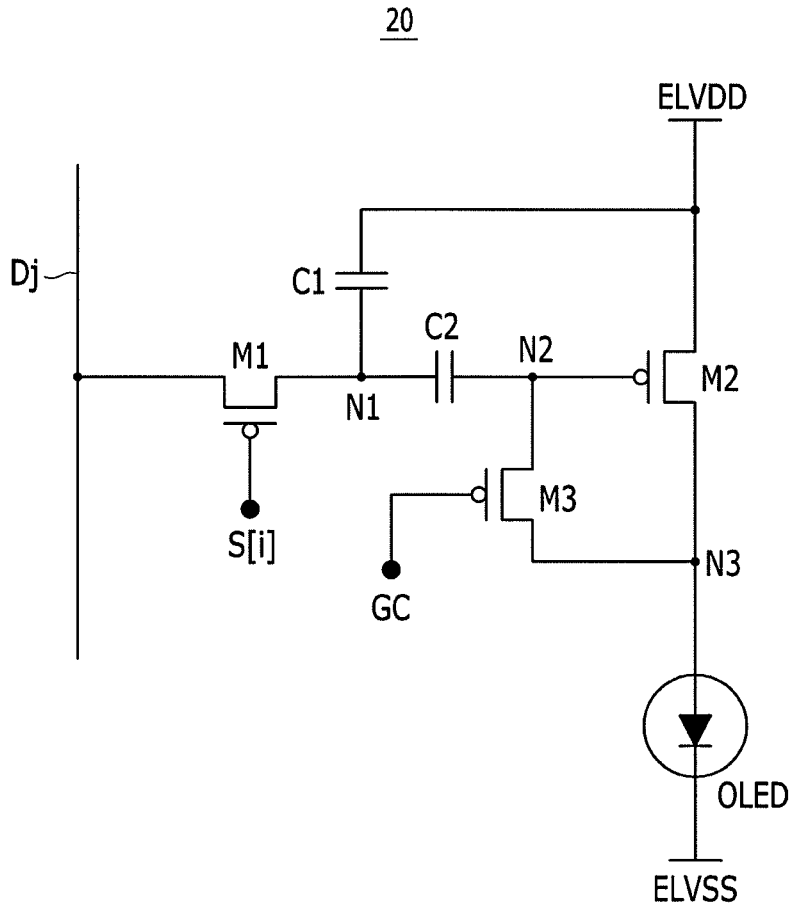
FIG. 3 is a circuit diagram of a pixel according to an exemplary embodiment.

FIG. 3 is a circuit diagram of a pixel according to an exemplary embodiment. Only a single pixel of the plurality of pixels included in the display device of FIG. 1 is illustrated for simplicity.

Referring to FIG. 3, the pixel 20 includes a switching transistor M1, a driving transistor M2, a compensation transistor M3, a storage capacitor C1, a compensation capacitor C2, and an organic light emitting diode (OLED).

The switching transistor M1 includes a gate electrode connected to the scan line, a first electrode connected to the data line Dj, and a second electrode connected to the first node N1. The switching transistor M is turned on by the scan signal S[i] of the gate-on voltage Von applied to the scan line such that the voltage applied to the data line Dj is transmitted to the first node N1.

The driving transistor M2 includes a gate electrode connected to the second node N2, a first electrode connected to the first power source voltage ELVDD, and a second electrode connected to the third node N3. The third node N3 is connected to an anode of the organic light emitting diode (OLED). The driving transistor M2 controls the driving current supplied to the organic light emitting diode (OLED) from the first power source voltage ELVDD.

The compensation transistor M3 includes the gate electrode connected to the compensation control line, one electrode connected to the second node N2, and the other electrode connected to the third node N3. The compensation transistor M3 is turned on by the compensation control signal GC of the gate-on voltage applied to the compensation control line connected to the gate electrode of the driving transistor M2 and the other electrode.

The storage capacitor C1 includes a first electrode connected to the first node and a second electrode connected to the first power source voltage ELVDD. The compensation capacitor C2 includes a first electrode connected to the second node N2 and a second electrode connected to the first node N1.

The organic light emitting diode (OLED) has an anode connected to the third node N3 and a cathode connected to the second power source voltage ELVSS. The organic light emitting diode (OLED) can emit one color of light of primary colors. As examples of the primary colors, there may be three primary colors of red, green, and blue, and a desired color may be displayed by a spatial and/or temporal sum of these three primary colors.

The switching transistor M1, the driving transistor M2, and the compensation transistor M3 may be p-channel field effect transistors. Here, the gate-on voltage turning on the switching transistor M1, the driving transistor M2, and the compensation transistor M3 is a logic low level voltage, and the gate-off voltage turning them off is a logic high level voltage.

The switching transistor M1, the driving transistor M2, and the compensation transistor M3 are p-channel field effect transistors, however at least one of the switching transistor M1, the driving transistor M2, and the compensation transistor M3 may be an n-channel field effect transistor, and the gate-on voltage for turning on the n-channel electric field effect transistor is the logic high voltage, while the gate-off voltage for turning it off is the logic low voltage.

The first power source voltage ELVDD and the second power source voltage ELVSS supply the driving voltage for the pixel operation.

Figure 4:
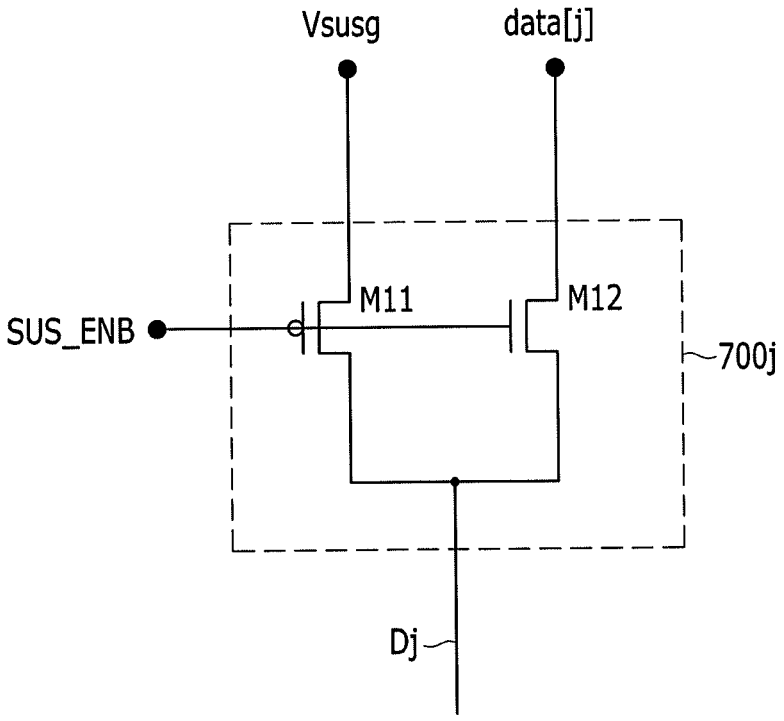
FIG. 4 is a block diagram of one example of a MUX unit included in the display device shown in FIG. 1.

FIG. 4 is a block diagram of one example of a unit MUX included in the display device of FIG. 1. Referring to FIG. 4, the MUX unit 700 includes a plurality of unit MUXs 700*j* respectively connected to a plurality of data lines. The unit MUX 700*j* includes a first transistor M11 and a second transistor M12.

The first transistor M11 has a gate electrode receiving the sixth driving control signal CONT6, i.e., the sustain voltage enable signal SUS_ENB, a first electrode connected to the sustain power supply unit 600 and receiving the first sustain voltage Vsusg, and a second electrode connected to the data line Dj. The second transistor M12 includes a gate electrode receiving the sustain voltage enable signal SUS_ENB, a first electrode connected to the data driver 300 and receiving the data signal data[j], and a second electrode connected to the data line Dj.

The first transistor M11 may be the p-channel field effect transistor, and the second transistor M12 may be the n-channel field effect transistor. That is, the first transistor M11 is turned on by the sustain voltage enable signal SUS_ENB of the logic low level to apply the first sustain voltage Vsusg to the data line Dj and, at this time, the second transistor M12 is turned off. Also, the second transistor M12 is turned on by the sustain voltage enable signal SUS_ENB of the logic high level to apply the data signal data[j] to the data line Dj and, at this time, the first transistor M11 is turned off.

Here, the first transistor M11 is the p-channel field effect transistor and the second transistor M12 is the n-channel field effect transistor. Alternatively, the first transistor M11 may be the n-channel field effect transistor and the second transistor M12 may be the p-channel field effect transistor.

Figure 5:
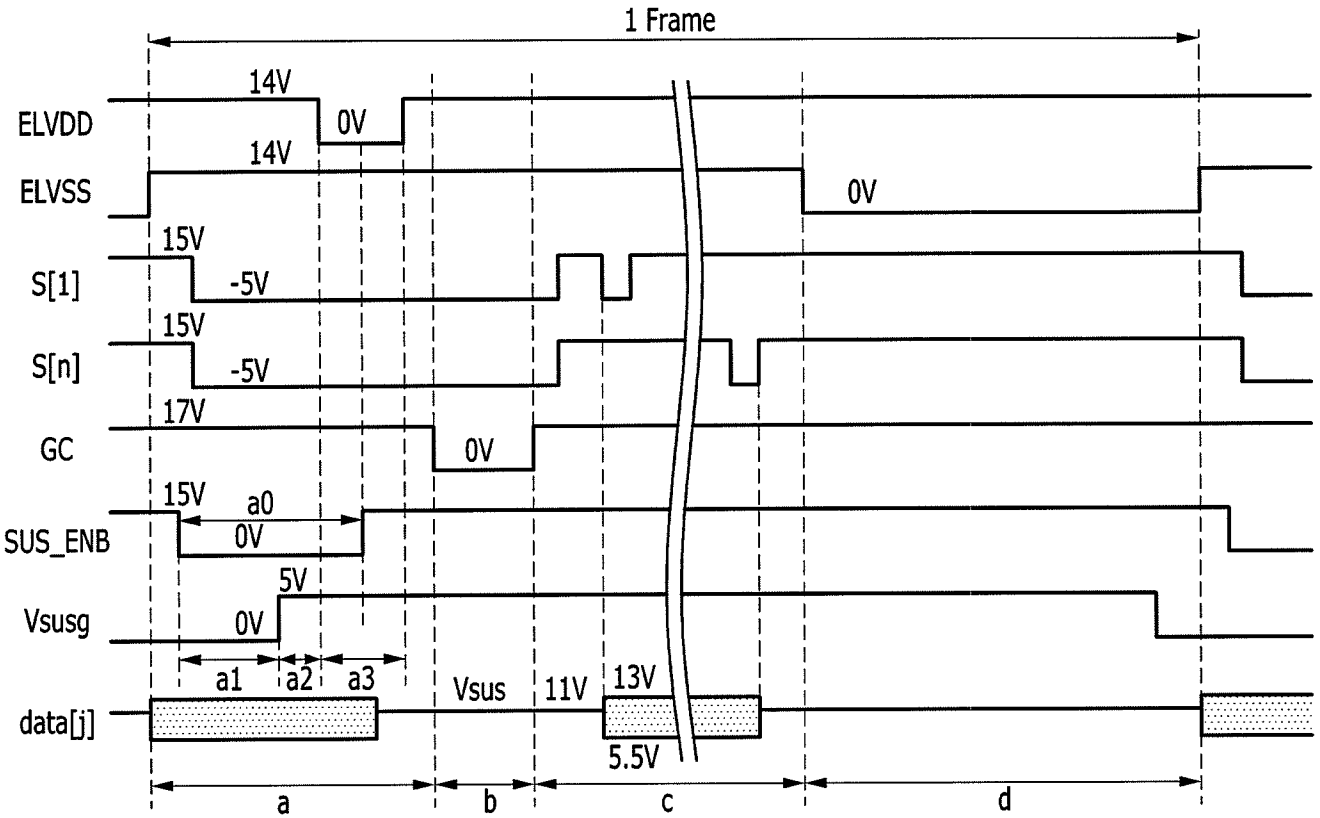
FIG. 5 is a timing diagram of a driving method of a display device according to an exemplary embodiment.

FIG. 5 is a timing diagram of a driving method of a display device according to an exemplary embodiment.

Referring to FIGS. 1 to 5, the reset period a includes a sustain voltage enable period a0 in which the first sustain voltage Vsusg is applied to the data line Dj. When the first transistor M11 of the unit MUX 700*j* is the p-channel field effect transistor, the sustain voltage enable signal SUS_ENB applied during the sustain voltage enable period a0 has the logic low level voltage.

The sustain voltage enable period a0 includes the first period a1 in which a first sustain voltage Vsusg is applied as the logic low level voltage, e.g., 0V, and a second period a2 in which the first sustain voltage Vsusg is changed and applied as the logic high level voltage, e.g., 5V. The second period a2 is a period from a time that the first sustain voltage Vsusg is changed into the logic high level voltage until a third period a3 at which the first power source voltage ELVDD changes from the logic high level voltage, e.g., 14 V, to the logic low level voltage, e.g., 0 V.

<The First Period a1 and the Second Period a2>

In the first period a1 and the second period a2, a plurality of scan signals S[1]-S[n] are applied as the logic low level voltage, e.g., −5V. At this time, the first power source voltage ELVDD and the second power source voltage ELVSS are applied as the logic high level voltage, e.g., 14 V, the compensation control signal GC is applied as the logic high level voltage, e.g., 17 V, and the data line Dj receives the first sustain voltage Vsusg of the logic low level voltage, e.g., 0 V. A plurality of data lines are not connected to the data driver 300 in the sustain voltage enable period a0 such that the data voltage may be applied with an arbitrary voltage or a predetermined second sustain voltage Vsus during the sustain voltage enable period a0.

The switching transistor M1 is turned on by the scan signals S[1]-S[n] of the logic low level voltage, e.g., −5V, and the first node N1 receives the first sustain voltage Vsusg of the logic low level voltage, e.g., 0 V. The voltage of the first node N1 changes from the data voltage Vdat applied in the scan period of the previous frame to the first sustain voltage Vsusg, and the voltage change amount of the first node N1 becomes Vsusg-Vdat. The data voltage Vdat means the voltage of the data signal data[j] and may have a range of, e.g., 5.5 V to 13 V.

The voltage of the second node N2 is changed by the voltage change amount of the first node N1 due to the coupling by the compensation capacitor C2. The voltage of the second node N2 becomes a state of ELVDD+Vth+(Vdat−Vsus) in the scan period of the previous frame. This will be described later in a description for the scan period (c).

The voltage of the second node N2 becomes ELVDD+Vth+(Vdat−Vsus)+(Vsusg−Vdat)=ELVDD+Vth−Vsus+Vsusg according to the voltage change of the first node N1. Here, ELVDD means the first power source voltage ELVDD, Vth means a threshold voltage of the driving transistor M2, Vsus means the second sustain voltage of a predetermined level, e.g., 11 V, applied to the plurality of data lines by the data driver 300 in a period other than the scan period (c).

For the following explanation, example values have been assumed, but embodiments are not limited thereto. In particular, it is assumed that ELVDD is 14 V, the threshold voltage Vth of the driving transistor M2 is −3 V, and Vsus is 11 V.

In the first period a1, it is assumed that the first sustain voltage Vsusg is 0 V such that the voltage of the second node N2 becomes 14−3−11+0=0 V. The first period a1 is a period in which the gate voltage of the driving transistor M2 is reset as 0 V to remove the hysteresis may occupy most of the sustain voltage enable period a0.

In the second period a2, it is assumed that the first sustain voltage Vsusg is applied as 5 V such that the voltage of the second node N2 becomes 14−3−11+5=5 V. By increasing the voltage of the second node N2 from 0 V to 5 V through the second period a2, in the later third period a3, the reverse bias of the organic light emitting diode (OLED) may be reduced. That is, the second period a2 is a period to control the reverse bias of the organic light emitting diode (OLED), i.e., the voltage difference of both terminals.

<The Third Period a3>

In the third period a3, the second power source voltage ELVSS maintains the logic high level voltage, e.g., 14 V, and the first power source voltage ELVDD is changed into the logic low level voltage, e.g., 0 V. At this time, the scan signal S[1]-S[n] is applied as the logic low level voltage, e.g., −5 V, and the compensation control signal GC is applied as the logic high level voltage, e.g., 17 V.

The voltage difference of the first power source voltage ELVDD and the second power source voltage ELVSS is reversed. Accordingly, the anode voltage of the organic light emitting diode (OLED) is higher than the first power source voltage ELVDD, and the anode of the organic light emitting diode (OLED) becomes the source relative to the driving transistor M2. The gate voltage of the driving transistor M2 is ELVDD+Vth−Vsus+Vsusg. The driving transistor M2 is turned on according the voltage difference of the gate-the source, and the current flows from the anode of the organic light emitting diode (OLED) to the first power source voltage ELVDD through the driving transistor M2. At this time, the current flowing through the driving transistor M2 flows until the anode voltage of the organic light emitting diode (OLED) reaches ELVDD−Vsus+Vsusg.

In the second period a2, the gate voltage of the driving transistor M2 becomes ELVDD+Vth−Vsus+Vsusg=5 V such that the anode voltage of the organic light emitting diode (OLED) becomes ELVDD−Vsus+Vsusg=8 V. That is, the anode voltage of the organic light emitting diode (OLED) is discharged to 8 V to be reset. At this time, the voltage difference between both terminals of the organic light emitting diode (OLED) becomes 14−8=6 V.

If the voltage of Vsusg is maintained as 0 V without the second period a2, the gate voltage of the driving transistor M2 becomes ELVDD+Vth−Vsus+Vsusg=0 V in the third period a3, and the anode voltage of the organic light emitting diode (OLED) becomes ELVDD−Vsus+Vsusg=3 V such that the voltage difference of both terminals of the organic light emitting diode (OLED) becomes 14−3=11 V.

As described above, in the second period a2 directly before the third period a3 in which the first power source voltage ELVDD is decreased to 0 V, the first sustain voltage Vsusg is changed from the first level voltage of 0 V to the second level voltage of 5 V such that the anode voltage of the organic light emitting diode (OLED) is controlled according to the voltage difference between the first level voltage and the second level voltage of the first sustain voltage in the third period a3 in which the anode voltage of the organic light emitting diode (OLED) is discharged and reset.

That is, the reverse bias of the organic light emitting diode (OLED) generated in the reset period (a) may be reduced, and generation of a dark spot due to the reverse bias of the high voltage generated in the organic light emitting diode (OLED) may be minimized.

Once the reset operation is completed within the reset period (a), the first power source voltage ELVDD is converted into the logic high level voltage, e.g., 14 V.

<The Compensation Period (b)>

In the compensation period (b), the scan signals S[1]-S[n] are applied as the logic low level voltage, e.g., −5V, and the compensation control signal GC is applied as the logic low level voltage, e.g., 0 V. The first power source voltage ELVDD and the second power source voltage ELVSS are applied as the logic high level voltage, e.g., 14 V. At this time, the sustain voltage enable signal SUS_ENB is applied as the logic high level voltage, e.g., 15 V, such the data signal data[j] is supplied to the data line Dj as the second sustain voltage Vsus.

The switching transistor M1 and the compensation transistor M3 are turned on. The second sustain voltage Vsus is transmitted to the first node N1 as the switching transistor M1 is turned on. The driving transistor M2 is diode-connected as the compensation transistor M3 is turned on. Due to the diode-connection of the driving transistor M2, the voltage of the third node N3 becomes a voltage of the first power source voltage ELVDD. Also, the gate voltage of the driving transistor M2, i.e., the voltage of the second node N2, becomes ELVDD+Vth. The voltage ELVDD+Vt−Vsus is stored by the compensation transistor C2.

As described above, during the compensation period (b), the compensation capacitor C2 stores the voltage ELVDD+Vth−Vsus reflected by the threshold voltage Vth of the driving transistor M2. After the compensation period (b), the compensation control signal GC and a plurality of scan signals S[1]-S[n] are converted into the logic high level voltage. Although the compensation transistor M3 is turned off and the switching transistor M1 is turned off, the ELVDD+Vth−Vsus voltage stored in the compensation capacitor C2 is maintained.

<The Scan Period (c)>

In the scan period (c), a plurality of scan signals S[1]-S[n] are sequentially applied as the logic low level voltage, e.g., −5V, such that the switching transistor M1 is turned on. At this time, the first power source voltage ELVDD and the second power source voltage ELVSS are the logic high level voltage, e.g., 14 V. The sustain voltage enable signal SUS_ENB is applied as the logic high level voltage, e.g., 15 V, and the data line Dj is applied with the data signal data[j]. The data signal data[j] may be applied as the data voltage Vdat having the range, e.g., 5.5 V to 13 V.

As the switching transistor M1 is turned on, the data voltage Vdat is transmitted to the first node N1. The voltage of the first node N1 is changed from the second sustain voltage Vsus to the data voltage Vdat, and the voltage change amount of the first node N1 becomes Vdat−Vsus. The storage capacitor C1 stores the data voltage Vdat of the first node N1.

By the coupling due to the compensation capacitor C2, the voltage of the second node N2 is changed by the voltage change amount Vdat-Vsus of the first node N1 thereby being ELVDD+Vth+(Vdat−Vsus). That is, the data voltage Vdat is reflected to the gate voltage of the driving transistor M2.

<The Light Emitting Period (d)>

When the light emitting period (d) starts, the first power source voltage ELVDD maintains the logic high level voltage, e.g., 14V, and the second power source voltage ELVSS is converted into the logic low level voltage, e.g., 0 V. That is, by changing one voltage level of the first power source voltage ELVDD and the second power source voltage ELVSS, the voltage difference between the first power source voltage ELVDD and the second power source voltage ELVSS is generated. At this time, a plurality of scan signals S[1]-S[n] are applied as the logic high level voltage, e.g., 15 V, the compensation control signal GC is applied as the logic high level voltage, e.g., 17 V, and the data signal data[j] is applied as the second sustain voltage Vsus.

As the second power source voltage ELVSS is converted into the logic low level voltage, e.g., 0 V, the current flows to the organic light emitting diode (OLED) through the driving transistor M2. The current flowing through the driving transistor M2 becomes $Ioled=\beta/2(Vgs-Vth)^2=\beta/2[\{ELVDD+Vth+(Vdat-Vsus)-ELVDD\}-Vth]^2=\beta/2(Vdat-Vsus)^2$. That is, the driving transistor M2 supplies the current corresponding to the data voltage Vdat reflected by the gate voltage to the organic light emitting diode (OLED). The organic light emitting diode (OLED) emits the light with the brightness corresponding to the current flowing to the driving transistor M2.

As a result, the current flowing to the organic light emitting diode (OLED) does not affect the threshold voltage deviation of the driving transistor M2 and the voltage drop of the first power source voltage ELVDD.

By way of summary and review, one or more embodiments may reduce or minimize a reverse bias generated in the organic light emitting diode (OLED) when hysteresis is removed. A high reverse bias may cause a plurality of dark spots on a screen, while reducing this reverse bias can reduce or minimize the dark spots.

The drawings referred to hereinabove and the detailed description of the disclosed invention are presented for illustrative purposes only, and are not intended to define meanings or limit the scope of the present invention as set forth in the following claims. Those skilled in the art will understand that various modifications and equivalent embodiments of the present invention are possible. Consequently, the true technical protective scope of the present invention must be determined based on the technical spirit of the appended claims.

DESCRIPTION OF SYMBOLS

10: display device
100: signal controller
200: scan driver
300: data driver
400: power supply unit
500: compensation control signal unit
600: sustain power supply unit
700: MUX unit
800: display unit

What is claimed is:

1. A display device, comprising:

a plurality of pixels connected to a first power source and a second power source, each pixel including an organic light emitting diode (OLED) and a driving transistor controlling a driving current supplied to the organic light emitting diode (OLED), wherein the driving transistor and the OLED are reset during a reset period of a frame, the reset period including a first period, a second period, and a third period;

a sustain power supply unit applying a first sustain voltage to a plurality of data lines connected to the plurality of pixels; and a data driver applying one of a data signal and a second sustain voltage to the plurality of data lines, wherein:

during the first period of the reset period, the sustain power supply unit applies the first sustain voltage as a first level voltage to the data lines in order to reset a gate voltage of the driving transistor in each pixel, and a voltage level of the first power source is equal or higher than a voltage level of the second power source, during the second period of the reset period after the first period of the reset period, the sustain power supply unit applies the first sustain voltage as a second level voltage higher than the first level voltage to the data lines in order to increase the gate voltage of the driving transistor in each pixel, and the voltage level of the first power source is equal or higher than the voltage level of the second power source, and during the third period of the reset period after the second period of the reset period, an anode voltage of the organic light emitting diode (OLED) in each pixel is discharged to be reset with a reset voltage, the reset voltage is controlled according to a voltage difference between the first level voltage and the second level voltage, and the voltage level of the first power source is lower than the voltage level of the second power source.

2. The display device of claim 1, wherein each pixel further includes:

a compensation capacitor including a first electrode connected to a gate electrode of the driving transistor;

a switching transistor connecting a second electrode of the compensation capacitor and a corresponding data line of the plurality of data lines; and a compensation transistor connecting the gate electrode of the driving transistor and an anode of the organic light emitting diode (OLED).

3. The display device of claim 2, further comprising a MUX unit connecting one of the sustain power supply unit and the data driver to the plurality of data lines.

4. The display device of claim 3, wherein the MUX unit includes a plurality of unit MUXs respectively connected to the plurality of data lines, each unit MUX including:

a first transistor including a gate electrode receiving a driving control signal, a first electrode connected to the sustain power supply unit, and a second electrode connected to the corresponding data line; and a second transistor including a gate electrode receiving with the driving control signal, a first electrode connected to the data driver, and a second electrode connected to the corresponding data line, wherein one of the first transistor and the second transistor is a p-channel field effect transistor, and another of the first transistor and the second transistor is an n-channel field effect transistor.

5. The display device of claim 3, further comprising a power supply unit determining voltage levels of the first power source and the second power source providing a driving current of the organic light emitting diode (OLED) and supplying the voltage levels of the first and second power sources to power source lines connected to the plurality of pixels.

6. The display device of claim 5, further comprising a compensation control signal unit applying a compensation control signal to the gate electrode of the compensation transistor to diode-connect the driving transistor and storing a voltage reflecting a threshold voltage of the driving transistor in the compensation capacitor.

7. The display device of claim 6, wherein when the driving transistor is diode-connected, the MUX unit connects the data driver to the plurality of data lines, and the data driver applies the second sustain voltage to the plurality of data lines.

8. The display device of claim 5, further comprising a scan driver sequentially applying a plurality of scan signals to a plurality of scan lines connected to the plurality of pixels, and the data driver applies the data signal to the plurality of data lines by corresponding to the plurality of scan signals to write the data signal to the plurality of pixels.

9. The display device of claim 8, wherein:

after writing the data signal to the plurality of pixels, the power supply unit changes one voltage level of the first power source and the second power source to simultaneously emit light of the plurality of pixels.

10. The display device of claim 1, wherein a voltage difference between the reset voltage and the voltage level of the second power source as a reverse bias voltage of the organic light emitting diode (OLED) decreases by increasing the voltage difference between the first level voltage and the second level voltage.

11. The display device of claim 1, wherein:

the data driver selectively supplies one of the data signal and the second sustain voltage to a MUX unit as a first input of the MUX according to a first control signal from a signal controller; and the sustain power supply unit selectively supplies one of the first voltage level and the second voltage level of the first sustain voltage to the MUX unit as a second input of the MUX according to a second control signal from the signal controller, wherein the MUX unit receives the first input from the data driver and the second input from the sustain power supply unit, and selectively outputs one of the first and second inputs to the plurality of pixels according to a driving control signal from the signal controller.

12. A method of driving a display device including a plurality of pixels connected to a first power source and a second power source, each pixel having an organic light emitting diode (OLED), a driving transistor controlling a driving current supplied to the organic light emitting diode (OLED), and a compensation capacitor having a first electrode connected to a gate electrode of the driving transistor, wherein the driving transistor and the OLED are reset during a reset period of a frame, the reset period including a first period, a second period, and a third period, the method comprising:

applying a first sustain voltage to a second electrode of the compensation capacitor as a first level voltage in order to reset a gate voltage of the driving transistor during the first period of the reset period, wherein a voltage level of the first power source is equal or higher than a voltage level of the second power source during the first period;

applying the first sustain voltage to the second electrode of the compensation capacitor as a second level voltage higher than the first level voltage in order to increase the gate voltage of the driving transistor during the second period of the reset period after the first period of the reset period, wherein the voltage level of the first power source is equal or higher than the voltage level of the second power source during the second period;

discharging an anode voltage of the organic light emitting diode (OLED) to be reset during the third period of the reset period after the second period of the reset period, wherein the voltage level of the first power source is lower than the voltage level of the second power source during the third period;

storing a voltage reflecting a threshold voltage of the driving transistor in the compensation capacitor;

applying a data voltage to the second electrode of the compensation capacitor to reflect the data voltage to the gate voltage of the driving transistor; and emitting light of the organic light emitting diode (OLED) according to the current flowing in the driving transistor by the gate voltage reflected by the data voltage, wherein, during the third period of the reset period, the anode voltage of the organic light emitting diode (OLED) is reset with a reset voltage, the reset voltage controlled according to a voltage difference between the first level voltage and the second level voltage.

13. The driving method of claim 12, wherein storing the voltage reflecting the threshold voltage of the driving transistor includes applying a second sustain voltage to the second electrode of the compensation capacitor; and diode-connecting the driving transistor.

14. The method of claim 13, wherein applying the data voltage to the second electrode of the compensation capacitor includes applying the first power source and the second power source that provide the driving current of the organic light emitting diode (OLED) at a same voltage level.

15. The method of claim 14, wherein:

emitting light of the organic light emitting diode (OLED) includes generating a voltage difference between the first power source and the second power source by changing one voltage level of the first power source and the second power source.

16. The method of claim 15, wherein emitting light of the organic light emitting diode (OLED) is simultaneously performed in the plurality of pixels.

* * * * *